US006641163B2

(12) United States Patent
Joubert des Ouches

(10) Patent No.: US 6,641,163 B2
(45) Date of Patent: Nov. 4, 2003

(54) INTERFACE ELEMENT USED ON A SNOWBOARD

(75) Inventor: Pascal Joubert des Ouches, Coublevie (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/790,394

(22) Filed: Feb. 21, 2001

(65) Prior Publication Data

US 2001/0015543 A1 Aug. 23, 2001

(30) Foreign Application Priority Data

Feb. 22, 2000 (FR) ..... 00 02174

(51) Int. Cl.[7] ..... A63C 9/10
(52) U.S. Cl. ..... 280/624; 280/617; 280/607
(58) Field of Search ..... 280/624, 602, 280/607, 610, 611, 61 B, 617, 618, 619, 623, 626, 629, 625, 14.21, 14.22, 14.24, 11.3; 36/117.2, 117.1, 117.3

(56) References Cited

U.S. PATENT DOCUMENTS

| | | | | | |
|---|---|---|---|---|---|
| 3,797,841 | A | * | 3/1974 | McAusland | 280/11.3 |
| 4,953,885 | A | * | 9/1990 | Comert et al. | 280/610 |
| 5,188,386 | A | * | 2/1993 | Schweizer | 280/607 |
| 5,236,216 | A | * | 8/1993 | Ratzek | 280/607 |
| 5,338,051 | A | | 8/1994 | Szafranski et al. | 280/607 |
| 5,503,900 | A | | 4/1996 | Fletcher | 428/160 |
| 5,564,728 | A | | 10/1996 | Renaud-Goud | 280/636 |
| 5,671,940 | A | * | 9/1997 | Abondance | 280/602 |
| 5,766,051 | A | * | 6/1998 | Messer | 441/65 |
| 5,848,796 | A | | 12/1998 | Meibock et al. | 280/11.22 |
| 5,895,068 | A | * | 4/1999 | Doyle | 280/618 |
| 5,897,408 | A | * | 4/1999 | Goode | 280/611 |
| 5,909,894 | A | | 6/1999 | Meader et al. | 280/623 |
| 5,944,337 | A | * | 8/1999 | Girard et al. | 280/615 |
| 5,971,407 | A | * | 10/1999 | Zemke et al. | 280/14.22 |
| 6,065,768 | A | * | 5/2000 | Lee | 280/613 |
| 6,116,635 | A | * | 9/2000 | Rigal | 280/618 |
| 6,123,354 | A | * | 9/2000 | Laughlin | 280/617 |
| 6,336,650 | B1 | * | 1/2002 | Alspaugh | 280/607 |
| 6,357,781 | B1 | * | 3/2002 | Jeandin | 280/14.22 |
| 2001/0010422 | A1 | * | 8/2001 | Merino et al. | 280/624 |

FOREIGN PATENT DOCUMENTS

| | | |
|---|---|---|
| WO | WO98/42419 | 10/1998 |

* cited by examiner

*Primary Examiner*—Brian L. Johnson
*Assistant Examiner*—Hau Phan
(74) *Attorney, Agent, or Firm*—Heslin Rothenberg Farley and Mesiti P.C.; John Pietrangelo

(57) ABSTRACT

An interface element (10) used on a gliding board, said element being inserted between the sole (20) of the user's boot and the top side of the board (8) so as to take the thrust exerted toward the board by the user at least at the front end of the sole, and which comprises at least one zone (11, 12, 15) made of a thermoformable material capable, after exposure to heat, of matching the imprint of at least the front end (21) of the sole (20) of the boot so as to fill the volume between the top side (8) of the board and the sole of the boot (20).

20 Claims, 5 Drawing Sheets

4
11
10
12
3
1
2

INTERFACE ELEMENT USED ON A SNOWBOARD

TECHNICAL FIELD

The invention relates to the field of gliding sports and, more particularly, to that of snowboarding. It relates more specifically to an interface element fitted between the sole of the boot and the binding (or the snowboard) to fill the gap between the sole and the binding or the board. Such interface elements are commonly known in snowboarding by the name of "gas pedal".

In the remainder of the description, the invention is described in its application to snowboarding, but it could be carried over to any kind of gliding board such as for alpine skiing, cross-country skiing or the like.

PRIOR ART

As is known, snowboarding is done either with rigid boots that resemble alpine ski boots or with flexible boots that collaborate with bindings that have rigid elements, particularly a highback, intended to provide support for the flexible boot.

The invention relates more precisely to this family of flexible boots and appropriate bindings.

Such boots are actually used for their comfort, allowing the user to walk unimpeded when he has stepped out of his board.

Now, to allow the foot to roll correctly during the walking motion, flexible boots have a sole which has a slight curvature such that the front and rear ends are slightly raised.

It can thus be appreciated that, at the front and/or rear ends of the boot, when the latter is in place in the binding, there is a certain unoccupied volume between the underside of the sole of the boot and the top side of the base of the binding, or alternatively the gliding board proper, depending on the architecture of the binding used.

This volume which is free of material therefore does not allow the user to transmit loads at the front and/or rear ends of the foot, even though, as is known, these constitute one of the main zones for the transmission of thrust.

It is to be noted that this problem of effectively transmitting thrust arises to a greater extent at the front end of the boot because thrust at the rear end of the boot is transmitted mainly via the highback of the binding. Nonetheless, the absence of effective support at the rear of the heel of the boot leads to inaccuracies in the feel and therefore in the control of the board.

Some solutions have already been proposed for solving this problem.

Document U.S. Pat. No. 5,503,900 describes a binding the base of which comprises additional elements located at the front and rear ends. These elements form inclined wedges, the top side of which is intended to come into contact with the sole of the boot at the front and at the rear. Thus, loads exerted near the tip of the boot are transmitted toward the base via this wedge-forming element. The clearance between the sole of the boot and the top side of the base is eliminated, which allows loads to be transmitted right from the first movements of the tip of the foot. The major drawback with these wedge-forming elements is that they are not able to adapt to suit different boot sizes, and that they therefore have to be repositioned each time the user changes boots.

Another source, document WO 98/42,419 proposes that the wedges be made adjustable in terms of longitudinal and transverse position, so that they can be adapted to suit different sole configurations. However, as the element has a given shape, it cannot correspond to all shapes of boot soles on the market.

Such a solution therefore has the major drawback that the wedge-forming element is present on only part of the surface of the sole of the boot, which means that the bearing surface of the boot is not used to the full and that some of the loads exerted by the user is not put to good use.

Furthermore, it is found that according to the various boot sole curvatures, a certain clearance may arise between the sole and the wedge-forming element. This clearance produces the aforementioned detrimental effects.

Finally, a certain amount of slippage may arise between the top face of the wedge-forming element and the sole, thus limiting the effectiveness with which loads are transmitted.

One of the problems that the invention sets out to solve is therefore that of optimizing the contact between the wedge-forming interface element and the sole of the boot in order to obtain the best possible transmission of loads.

The invention therefore sets out to provide an interface element intended to be inserted between the sole of the boot and the binding or the top side of the board, which affords optimum support irrespective of the size of the boot and of its geometry.

SUMMARY OF THE INVENTION

The invention therefore relates to an interface element used on a gliding board, said element being inserted between the sole of the user's boot and the top side of the board so as to transmit the thrust exerted toward the board by the user at least at the front end of the sole.

The element according to the invention is one which comprises at least one zone made of a thermoformable material capable, after exposure to heat, of matching the imprint of at least the front end of the sole of the boot so as to fill the volume between the top side of the board and the sole of the boot.

In other words, the characteristic element is made of a material which can adopt the exact shape of the underside of the sole of the boot, which allows the boot to be immobilized extremely precisely in position with respect to the binding.

The collaboration between the patterns on the sole and the corresponding patterns molded in the thermoformable zone provides almost perfect immobilization of the boot with respect to the binding, regardless of the sole geometry.

Furthermore, the thermoformable material used is compressed and therefore rigidified at the time of molding by the sole, which increases its ability to transmit thrust, particularly by comparison with the devices of the prior art made of elastomeric materials.

The interface element according to the invention can be fitted either directly over the base of the binding or directly over the top side of the board when the architecture of the binding has no base, such as in bindings of the type known by the designation "baseless".

The interface element may equally be placed directly on the top side of the board and pass through the base of the binding in openings made therein for that purpose.

The interface element according to the invention may be present either at the front end of the boot or at the rear end of the latter, or at both these ends. It may alternatively form a single element covering the entire surface of the sole of the boot, extending from one end of the latter to the other.

In an advantageous form, the interface element comprises, at the front and/or rear ends, and beneath the zone of thermoformable material, an additional zone of rigid material so as to provide for good transmission of thrust exerted toward the board.

In effect, according to this characteristic, the rigidity of the interface element, at the front or rear ends, is relatively great and combines the rigidity of the thermoformable zone proper with that of the underlying zone.

When the interface element extends under the entire length of the boot, it may prove advantageous for it to comprise at least in the region of the heel and beneath or at the location of the zone of deformable material, a zone of flexible material so as to damp vibrations from the board, and to damp jolts, particularly when taking jumps.

In other words, at its rear end the interface element has a relatively compressible zone which absorbs some of the energy of the vibrations transmitted by the board, in the region of the sole where the transmission of thrust is not predominant.

Advantageously in practice, the interface element according to the invention may be covered with an impervious protective layer made, for example, of a fabric coated with polytetrafluoroethylene. Such a protective layer prevents snow, water and ice from getting into the cells of the foam of the thermoformable element. Such a protective layer may also bear decoration.

BRIEF DESCRIPTION OF THE FIGURES

The way of embodying the invention and the advantages ensuing therefrom will become clearly apparent from the description of the embodiment which follows, in support of the appended figures, in which.

EMBODIMENT OF THE INVENTION

As already stated, the invention relates to an interface element intended to be fitted between the sole of the boot and the binding or the top side of the board, so as to compensate for the curvature of the sole of the boot.

Figure 1:
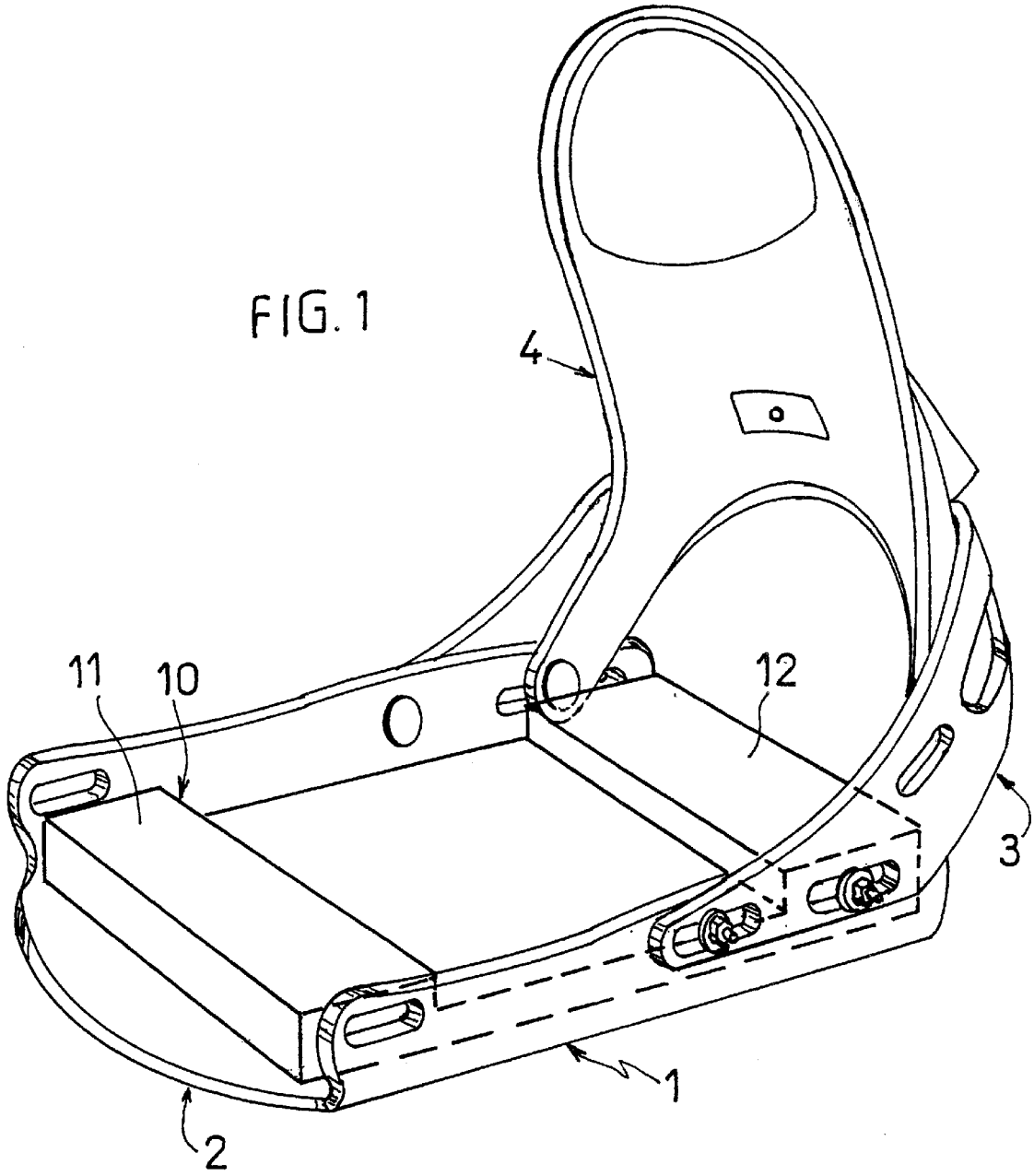
FIG. 1 is a brief perspective view of a board binding equipped with an interface element according to the invention.

As illustrated in FIG. 1, the characteristic element (10) can be fitted on the base (2) of the binding (1).

In the embodiment illustrated, this base (2) comprises a rear bow (3) passing behind the foot and holding an articulated highback (4) intended to act as rear support for the boot upper.

Obviously, the invention is not restricted to this single binding architecture and can be used in particular in so-called "baseless" bindings which have no actual base proper but just have two lateral members, the interface element then resting directly on the top side of the board (8).

In the same way, the invention is not restricted to the embodiment illustrated in FIG. 1 in which the interface element (10) extends over the entire surface of the base (2), but it also covers variants in which the interface element is present only at the front end and/or the rear end.

As illustrated in FIGS. 1 to 4, the characteristic element (10) shown by way of nonlimiting example, extends under the entire length of the sole (20).

As already stated, the sole (20) belongs to a flexible boot which is used in particular for its comfort when walking. This sole has, illustrated in an exaggerated fashion, a certain curvature which allows the foot to roll during walking.

This curvature means that the point (21) of the boot and the rear end (22) of the heel are slightly raised relative to the lowermost level (23) of the boot which is located roughly from one side of the instep to the other. This difference in height is of the order of one centimeter.

According to the invention, the interface element (10) has a part (11, 12) intended to fill the space between the front (21) and/or rear (22) ends of the sole (20) and the base (2) of the binding.

According to one feature of the invention, these parts (11, 12) of the interface element (10) consist essentially of a thermoformable material capable of deforming under the action of heat.

Figure 2:
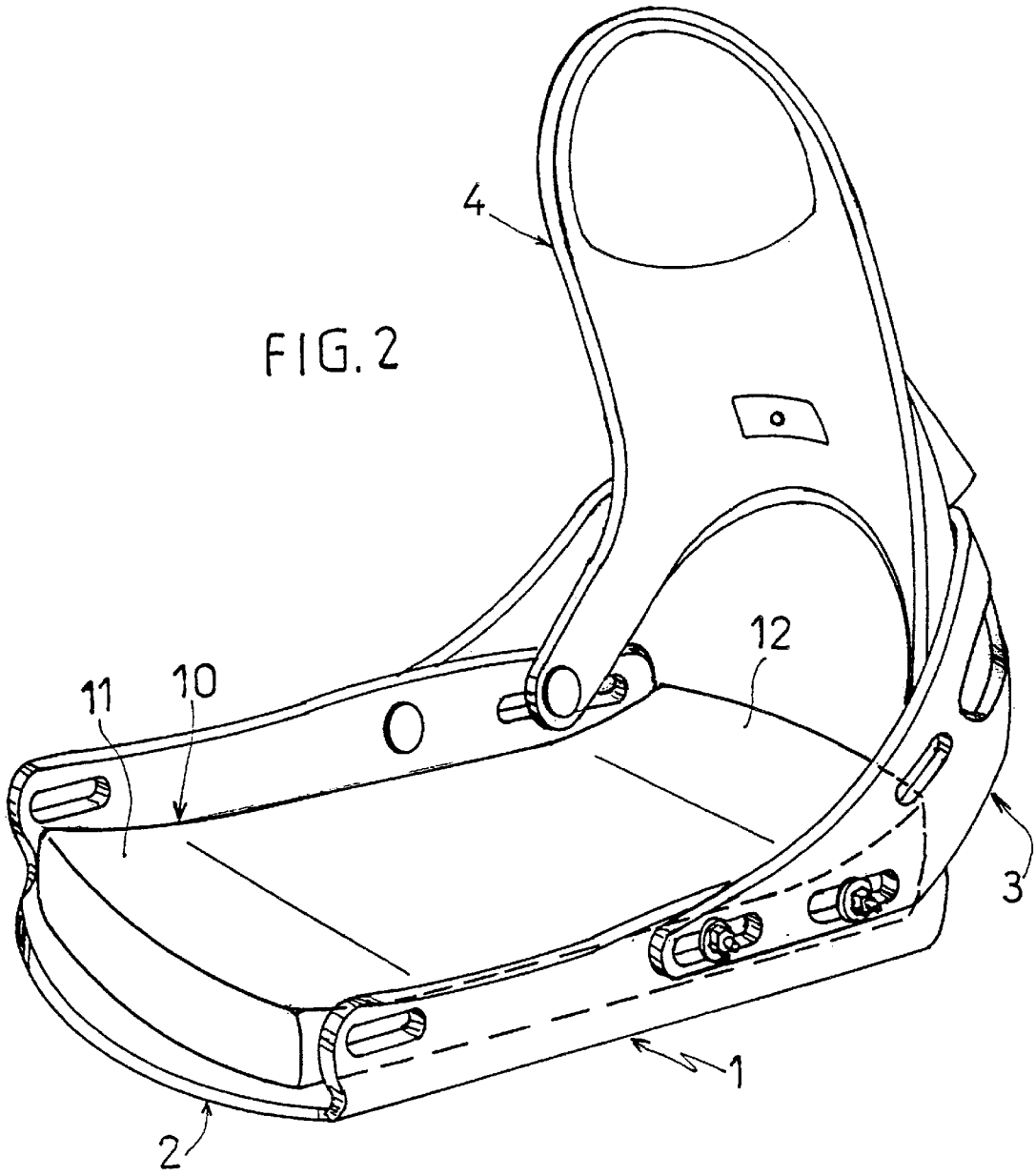
FIG. 2 corresponds to FIG. 1 after the characteristic element has been thermoformed.
Figure 3:
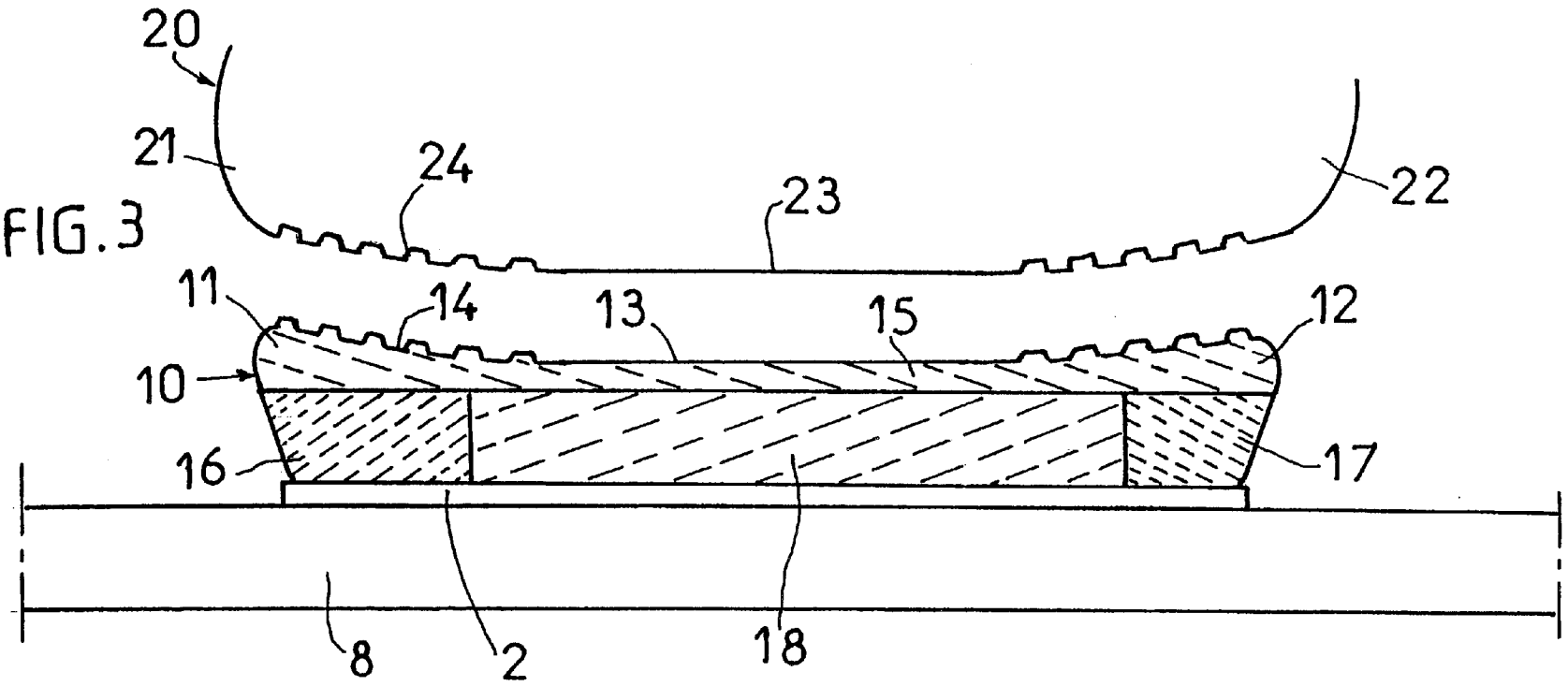
FIG. 3 is a view in longitudinal section of FIG. 2 showing the board, the base of the binding and the interface element.

By virtue of this feature, the user can give the top side (13) of the interface element (10) a shape that complements that of its sole (20), thus increasing the area of contact between the sole and the interface element (see FIGS. 2 and 3).

More specifically, when the sole has ridged reliefs (24), the thermoformable material of the characteristic element (11) deforms to insert itself at least partially between the various reliefs (24) and constitute highly efficient interlock zones (14).

More generally, the thermoformable material follows the particular curvature of the sole (20) so as to provide contact which is as effective as possible.

In practice, all that the user has to do is to expose the thermoformable material to a source of heat, such as a hot air gun for example, or an oven, to temporarily give the material an ability to deform, and then apply the sole of the boot to the interface element, by placing it in the binding as illustrated in FIG. 1, by stepping into this binding and tightening it in the normal way, then leaving it to cool so that, in its thermoformable zones, the element adopts the imprint of the sole as illustrated in FIG. 2.

In an improved version, the element is equipped with an electric resistive element embedded in the material or trapped under the thermoformable zones, so that it can be heated by an electric current.

Numerous materials can be used to fulfil this thermoforming function, provided that their softening temperature is low enough. Mention may, for example, be made of closed-cell ethylene vinyl acetate foam of the ULTRALON® type, marketed by ULTRALON PRODUCT.

Incidentally, and according to another feature of the invention, the interface element (10) may comprise, beneath the thermoformable regions (11, 12), zones (16, 17) made of a relatively rigid plastic intended to transmit the thrust exerted by the end of the foot toward the board.

Such a plastic may, for example, be a polyurethane foam or even a solid material such as acrylonitrilbutadiene styrene.

Thus, the part of the interface element (10) located vertically in line with the front (21) and/or rear (22) ends is rigid enough for thrust to be transmitted effectively.

In addition, the intermediate region (18) of the interface element, located between the front and rear ends, vertically in line with the central part (23) or instep of the boot has, beneath the thermoformable part (15), a zone made of a relatively more flexible material, consisting of a shock-absorbing plastic.

Such a zone (15) may be made of low-density ethylene vinyl acetate or any other cellular material.

Thus, the zone (15, 18) of the interface element (10) located beneath the instep has a certain elasticity which makes it possible to absorb some of the vibration transmitted by the board. User comfort is thus enhanced.

Figure 4:
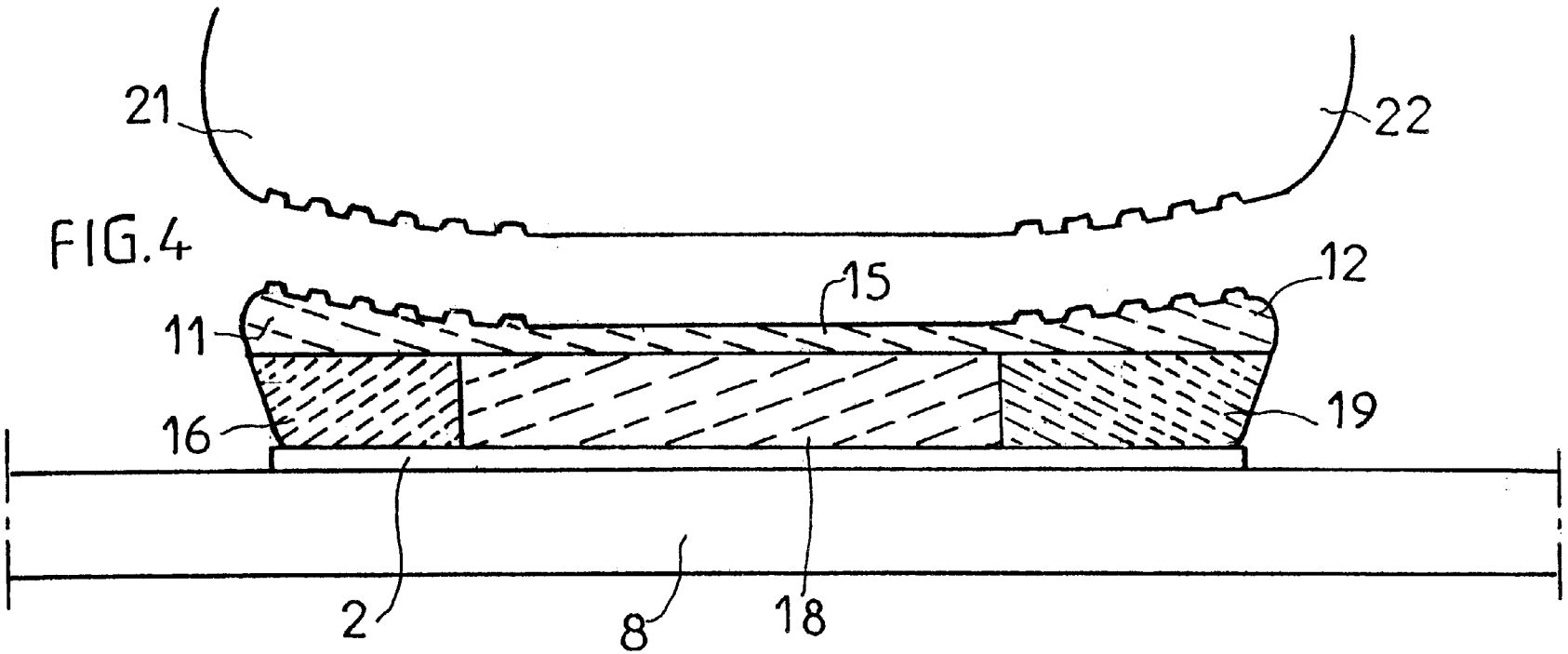
FIG. 4 is a view in section of a variant embodiment of FIG. 3.

In a variant, a shock-absorbing zone may extend in a fashion relatively set back toward the rear, for example as far as under the heel. This is because the need for effective transmission of thrust vertically in line with the heel is less important than the similar transmission near the point of the boot, because the highback (4) of the binding transmits most of the backward thrust. By contrast, as illustrated in FIG. 4, it may be advantageous to have a highly damping zone (19) under the heel, particularly when taking jumps. A zone such as this will preferably be made of a viscoelastic shock-absorbing material of the PODIANE® or SORBOTANE® type.

According to another feature of the invention, the interface element may be enveloped in a fabric advantageously covered with polytetrafluoroethylene intended to seal the entity.

This is because, given the cellular nature of the foams used, it is preferable to prevent water from entering this material and degrading its mechanical properties when it freezes, especially if certain constituent parts of the element are made of open-cell foam. This fabric may advantageously bear a decoration.

As already stated, the interface element can adopt numerous architectures to collaborate with the binding and the gliding board.

Figure 5:
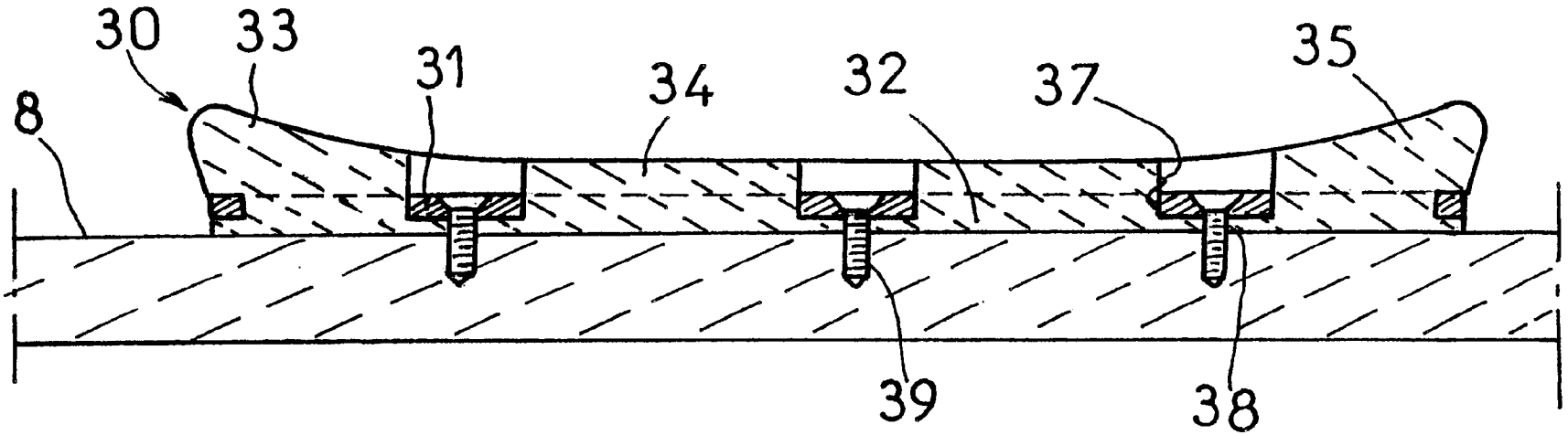
FIG. 5 is a view in longitudinal section of a variant embodiment.

Thus, in one of the variants illustrated in FIG. 5, the interface element (30) has a bottom part (32) which rests on the board. The element (30) takes the base (31) of the binding in housings provided for that purpose so that the thermoformable zones (33, 34, 35) of this element pass through recesses (37) made between the parts of the base.

In this case, the characteristic element may have drillings (38) intended to take the screws (39) that attach the base (31) to the board proper.

In the variant illustrated in FIG. 2, the interface element (10) may be either bonded to the base using an appropriate adhesive or may have a shape such that it fits into the base without the need to use an adhesive.

It emerges from the foregoing that the interface element according to the invention offers numerous advantages, particular that of optimizing the transmission of thrust from the front and rear zones of the boot by eliminating any clearance between the boot and the base of the binding. The use of a thermoformable material makes it possible to provide as large as possible an area of contact between the sole and the characteristic element, thus avoiding any slippage or any clearance that is detrimental to the transmission of thrust.

What is claimed is:

1. An interface element used on a gliding board, said element being inserted between a sole the user's boot, the sole having ridged reliefs, and a top side of the board so as to take the thrust exerted toward the board by the user when in use at least at the front end of the sole, the interface element comprising at least one zone made of a thermoformable material formed, after exposure to heat, having interlocking zones for matching the ridged reliefs of the sole at least at the front end of the sole of the boot so as to fill the volume between the top side of the board and the sole of the boot.

2. The interface element as claimed in claim 1, wherein the interface element is adapted to be fitted above the base of the binding.

3. The interface element as claimed in claim 1, wherein the interface element is adapted to be fitted on the top side of the board.

4. The interface element as claimed in claim 1, wherein the interface element is adapted to be fitted on the top side of the board and to pass partially through the base of the binding.

5. The interface element as claimed in claim 1, wherein the interface element extends under the entire surface of the sole of the boot.

6. The interface element as claimed in claim 5, wherein the interface element comprises a thermoformable zone at the front end and a thermoformable zone at the rear end.

7. The interface element as claimed in claim 6, wherein the interface element comprises, at least in the region of the heel and beneath or at the location of the zone of deformable material, a zone of flexible material so as to damp vibrations and/or jolts from the board.

8. The interface element as claimed in claim 1, wherein the interface element comprises, at the front and/or rear ends, and beneath the zone of thermoformable material, a zone of rigid material so as to provide for good transmission of thrust exerted toward the board.

9. The interface element as claimed in claim 1, wherein the interface element is covered with an impervious protective layer.

10. An interface element as recited in claim 1, wherein the thermoformable material comprises an ethylene vinyl acetate.

11. A binding for a gliding board including an interface element, the interface element being inserted between a sole of the user's boot the sole have ridged reliefs, and a top side of the board so as to take the thrust exerted toward the board by the user when in use at least at the front end of the sole, wherein the interface element comprises at least one zone made of a thermoformable material formed, after exposure to heat, having interlocking zones for matching the ridged reliefs of the sole at least at the front end of the sole of the boot so as to fill the volume between the top side of the board and the sole of the boot.

12. A binding as recited in claim 11, wherein the interface element is adapted to be fitted above the base of the binding.

13. A binding as recited in claim 11, wherein the interface element is adapted to be fitted on the top side of the board.

14. A binding as recited in claim 11, wherein the interface element is adapted to be fitted on the top side of the board and to pass partially through the base of the binding.

15. A binding as recited in claim 11, wherein the interface element extends under the entire surface of the sole of the boot.

16. A binding as recited in claim 15, wherein the interface element comprises a thermoformable zone at the front end and a thermoformable zone at the rear end.

17. A binding as recited in claim 16, wherein the interface element comprises, at least in the region of the heel and beneath or at the location of the zone of deformable material, a zone of flexible material so as to damp vibrations and/or jolts from the board.

18. A binding as recited in claim 11, wherein the interface element comprises, at the front and/or rear ends, and beneath the zone of thermoformable material, a zone of rigid material so as to provide for good transmission of thrust exerted toward the board.

19. A binding as recited in claim 11, wherein the interface element is covered with an impervious protective layer.

20. A binding as recited in claim 11, wherein the thermoformable material comprises an ethylene vinyl acetate.

* * * * *

UNITED STATES PATENT AND TRADEMARK OFFICE

CERTIFICATE OF CORRECTION

PATENT NO. : 6,641,163 B2
DATED : November 4, 2003
INVENTOR(S) : Joubert des Ouches It is certified that error appears in the above-identified patent and that said Letters Patent is hereby corrected as shown below:

Column 5,
Line 61, insert the word -- of -- after the word "sole"

Column 6,
Line 38, insert a -- , -- after the word "boot"

Signed and Sealed this

Thirteenth Day of January, 2004

JON W. DUDAS
*Acting Director of the United States Patent and Trademark Office*